US008366238B2

(12) United States Patent
Tu et al.

(10) Patent No.: US 8,366,238 B2
(45) Date of Patent: Feb. 5, 2013

(54) INKJET HEAD MAINTENANCE DEVICE

(75) Inventors: Tung-Wen Tu, Taipei (TW); Jian Zeng, Guangzhou (CN)

(73) Assignee: Primax Electronics Ltd., Taipei (TW)

( * ) Notice: Subject to any disclaimer, the term of this patent is extended or adjusted under 35 U.S.C. 154(b) by 218 days.

(21) Appl. No.: 13/033,412

(22) Filed: Feb. 23, 2011

(65) Prior Publication Data

US 2012/0147091 A1 Jun. 14, 2012

(30) Foreign Application Priority Data

Dec. 10, 2010 (TW) ..... 99143197 A

(51) Int. Cl.
*B41J 2/165* (2006.01)

(52) U.S. Cl. ..... 347/33; 347/32

(58) Field of Classification Search ..... 347/20, 347/22, 29, 31–34, 37
See application file for complete search history.

(56) References Cited

U.S. PATENT DOCUMENTS 7,748,823 B2 * 7/2010 Hung ..... 347/33

* cited by examiner

*Primary Examiner* — Thinh Nguyen
(74) *Attorney, Agent, or Firm* — Kirton McConkie; Evan R. Witt

(57) ABSTRACT

An inkjet head maintenance device includes a power gear and a sliding seat. The sliding seat includes a rack, a first one-way gear and a second one-way gear. The first one-way gear and the second one-way gear are arranged at two ends of the rack, respectively. The power gear is engaged with the rack. In addition, through the first one-way gear and the second one-way gear, the sliding seat is driven by the power gear to move between a standby position and a maintenance position in a reciprocating manner. When the sliding seat is driven by the power gear to move to the maintenance position, the power gear is engaged with the second one-way gear, so that the sliding seat is stayed in the maintenance position to the clean an inkjet head.

11 Claims, 7 Drawing Sheets

INKJET HEAD MAINTENANCE DEVICE

FIELD OF THE INVENTION

The present invention relates to an inkjet head maintenance device, and more particularly to an inkjet head maintenance device for use in a printer.

BACKGROUND OF THE INVENTION

Recently, with widespread applications of the internet, printers are widely and frequently used in the offices to print out data. Among a variety of printing devices, inkjet printers are the most popular. During operation of an inkjet printer, an inkjet head disposed on an inkjet head holder will accurately eject ink on designated positions of a paper (or another medium), so that corresponding characters or pictures are printed on the paper (or another medium). However, during the printing process of the inkjet head, residual ink is readily accumulated around the inkjet nozzle of the inkjet head, or the dust from the surface of the paper is readily accumulated around the inkjet nozzle. Under this circumstance, the inkjet nozzle is clogged, and thus the printing quality is deteriorated, for example, the ink density is uneven or the ink color is inaccurate. Therefore, for enhancing the printing quality and prolonging the use life of the inkjet head, it is necessary to keep the clean condition of the inkjet nozzle of the inkjet head.

FIG. 1 is a schematic exploded view illustrating a conventional inkjet head maintenance device, which is disclosed in for example Taiwanese Patent No. I329073. As shown in FIG. 1, the inkjet head maintenance device 1 comprises a base member 10, a sliding seat 11 and a supporting tray 12. The supporting tray 12 is disposed on the sliding seat 11 for cleaning and maintaining an inkjet head (not shown). The sliding seat 11 is disposed on the base member 10. For moving the sliding seat 11 on the base member 10 in a reciprocating manner to allow the supporting tray 12 to clean and maintain the inkjet head, a driving gear set 13, a transmission rod 14 and a transmission gear set 15 are installed on a sidewall of the base member 10. The driving gear set 13 comprises a first main gear 131, a second main gear 132, a third main gear 133, a first internal gear 134 and a fourth main gear 135. The first main gear 131 is arranged beside the second main gear 132 for driving rotation of the second main gear 132. The second main gear 132 is engaged with the third main gear 133 for driving rotation of the third main gear 133. The third main gear 133 is arranged beside the first internal gear 134 for driving rotation of the first internal gear 134. The first internal gear 134 is engaged with the fourth main gear 135 for driving rotation of the fourth main gear 135. The transmission gear set 15 is engaged with two racks 111 of the sliding seat 11. On the other hand, the transmission gear set 15 comprises a first transmission gear 151, a second transmission gear 152, a main transmission shaft 153 and two internal transmission gears 154 and 155. The internal transmission gears 154 and 155 of the transmission gear set 15 are engaged with the two racks 111 of the sliding seat 11, respectively.

Once the inkjet head is moved to a position over the inkjet head maintenance device, a task of cleaning and maintaining the inkjet head or a task of humidifying the inkjet head may be performed. For performing such task, the transmission gear set 15 is connected with the driving gear set 13, so that a driving force provided by the driving gear set 13 can be transmitted to the sliding seat 11. Meanwhile, the first transmission gear 151 of the transmission gear set 15 is engaged with the fourth main gear 135 of the driving gear set 13, and the second main gear 132 and the third main gear 133 of the driving gear set 13 are engaged with each other. Consequently, the driving force can be transmitted from the driving gear set 13 to the transmission gear set 15. Then, the second transmission gear 152 and the main transmission shaft 153 are successively driven to rotate. Afterwards, the internal transmission gears 154 and 155 that are disposed within a first groove wall are driven by the main transmission shaft 153 to rotate. In such way, by controlling the rotating direction of the driving gear set 13, the rotating directions of the internal transmission gears 154 and 155 are adjustable. Moreover, since the internal transmission gears 154 and 155 are respectively engaged with the two racks 111, the direction of moving the sliding seat 11 within the base member 10 is adjustable.

The conventional inkjet head maintenance device, however, still has some drawbacks. For example, it is troublesome to assemble many gears of the inkjet head maintenance device. Therefore, there is a need of providing an improved inkjet head maintenance device with reduced assembling complexity.

SUMMARY OF THE INVENTION

The present invention provides an inkjet head maintenance device with reduced assembling complexity.

In accordance with an aspect of the present invention, there is provided an inkjet head maintenance device for cleaning and maintaining an inkjet head. The inkjet head maintenance device includes a power gear and a sliding seat. The power gear is used for providing a driving force. A scraping element is disposed on the sliding seat for scraping off residual ink on the inkjet head. The sliding seat further includes a rack, a first guiding slot, a second guiding slot, a first fastening part, a second fastening part, a first one-way gear and a second one-way gear. The rack may be engaged with the power gear, so that the sliding seat is moved between a standby position and a maintenance device in response to rotation of the power gear. The first guiding slot and the second guiding slot are arranged at two ends of the rack, respectively. The first fastening part and the second fastening part are arranged at the two ends of the rack, respectively. The first one-way gear and the second one-way gear are disposed within the first guiding slot and the second guiding slot, respectively. When the sliding seat is in the standby position, in response to rotation of the power gear in a first direction, the first one-way gear is coupled with the first fastening, so that the power gear is disengaged from the first one-way gear and then engaged with the rack. When the power gear is engaged with the rack, in response to continuous rotation of the power gear in the first direction, the sliding seat is departed from the standby position and moved toward the maintenance position. When the sliding seat is moved to the maintenance position, the power gear is disengaged from the rack and then engaged with the second one-way gear, so that the second one-way gear is detached from the second fastening part to result in idle running and the sliding seat is stayed in the maintenance position. When the sliding seat is stayed in the maintenance position, in response to rotation of the power gear in a second direction, the power gear allows the second one-way gear to be coupled with the second fastening part, and the power gear is disengaged from the second one-way gear and then engaged with the rack, so that the sliding seat is moved toward the standby position.

In an embodiment, the sliding seat further includes a first receptacle and a second receptacle, which are arranged at the two ends of the rack, respectively. The first guiding slot and the first fastening structure are disposed in the first receptacle. The second guiding slot and the second fastening structure are disposed in the second receptacle.

In an embodiment, the rack, the first receptacle and the second receptacle are arranged at a bottom surface of the sliding seat.

In an embodiment, the first one-way gear and the second one-way gear are linearly movable within the first guiding slot and the second guiding slot, respectively.

In an embodiment, the inkjet head maintenance device further includes a base member with a sliding track, and the sliding seat further includes a first protruding post accommodated within the sliding track, so that the sliding seat is movable along the sliding track.

In an embodiment, the inkjet head maintenance device further includes a supporting seat with a supporting tray and a second protruding post, and the sliding seat further includes an ascending and descending track. The second protruding post is accommodated within the ascending and descending track. The inkjet head is enclosed by the supporting tray.

In an embodiment, the base member further includes a stopping part. When the sliding seat is moved toward the maintenance position in response to rotation of the power gear in the first direction, the supporting seat is stopped by the stopping part, and second protruding post is ascended along the ascending and descending track, so that the supporting seat is ascended with respect to the sliding seat to enclose the inkjet head.

In an embodiment, the supporting tray is connected with the supporting seat through a first elastic element. When the supporting seat is ascended with respect to the sliding seat to enclose the inkjet head, in response to an elastic force provided by the first elastic element, the inkjet head is tightly enclosed by the supporting tray.

In an embodiment, the supporting post is connected with the sliding seat through a second elastic element. When the sliding seat is moved toward the standby position in response to rotation of the power gear in the second direction, the supporting seat is detached from the stopping part. In response to a tension force provided by the second elastic element, the second protruding post is descended along the ascending and descending track, so that the supporting seat is descended with respect to the sliding seat.

In an embodiment, an ink-absorbing sponge is disposed on the supporting tray for absorbing the residual ink on the inkjet head.

In an embodiment, the supporting seat further includes an ink-discharging tube. The residual ink absorbed by the ink-absorbing sponge is exhausted out through the ink-discharging tube.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 2:
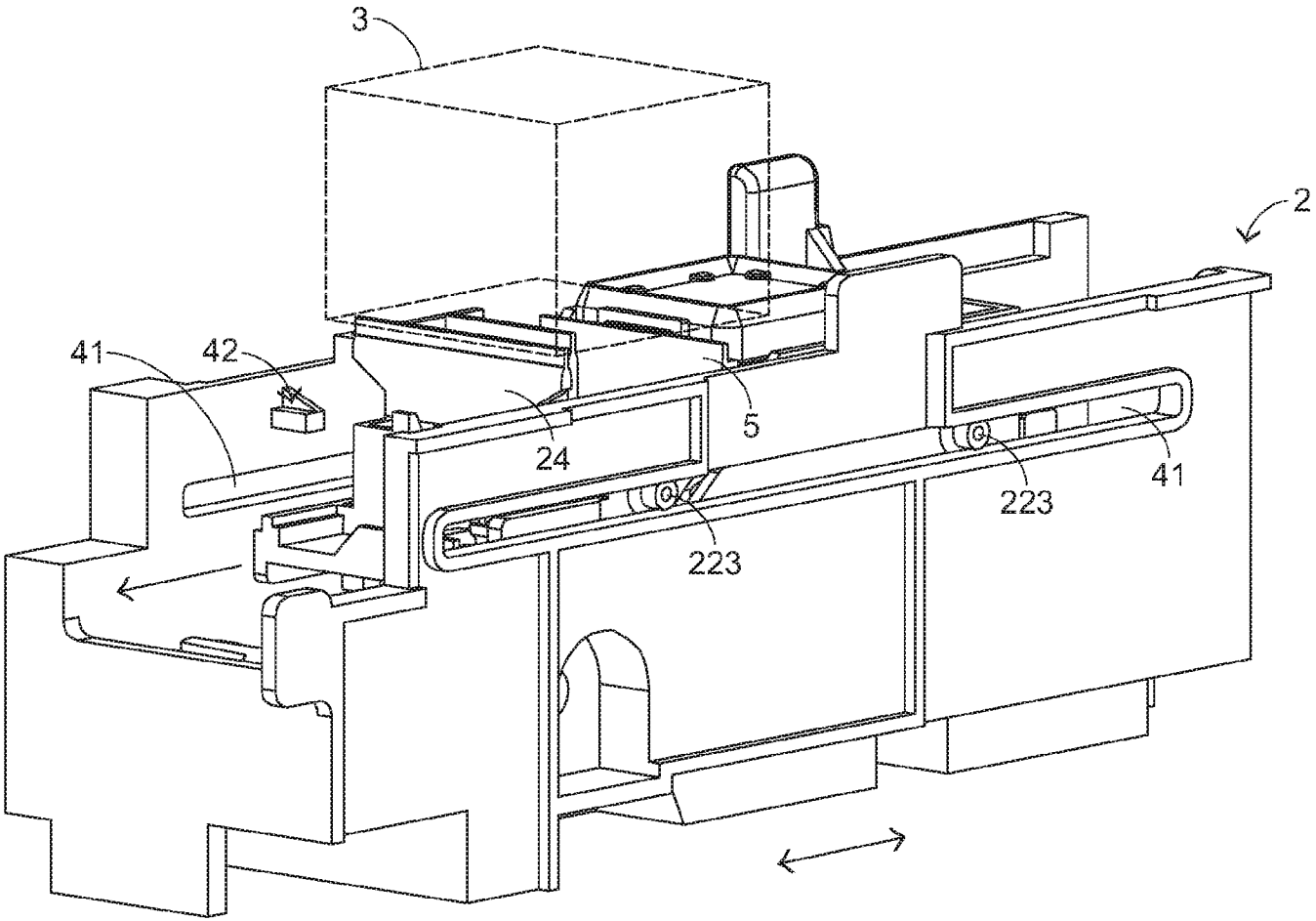
FIG. 2 is a schematic perspective view illustrating an inkjet head maintenance device according to an embodiment of the present invention.

FIG. 2 is a schematic perspective view illustrating an inkjet head maintenance device according to an embodiment of the present invention. The inkjet head maintenance device 2 is used to clean and maintain the inkjet head 3. After a printing task is completed, the inkjet head 3 is moved to a position over the inkjet head maintenance device 2. At this moment, the inkjet head maintenance device 2 performs a task of cleaning and maintaining the inkjet head 3.

Figure 3:
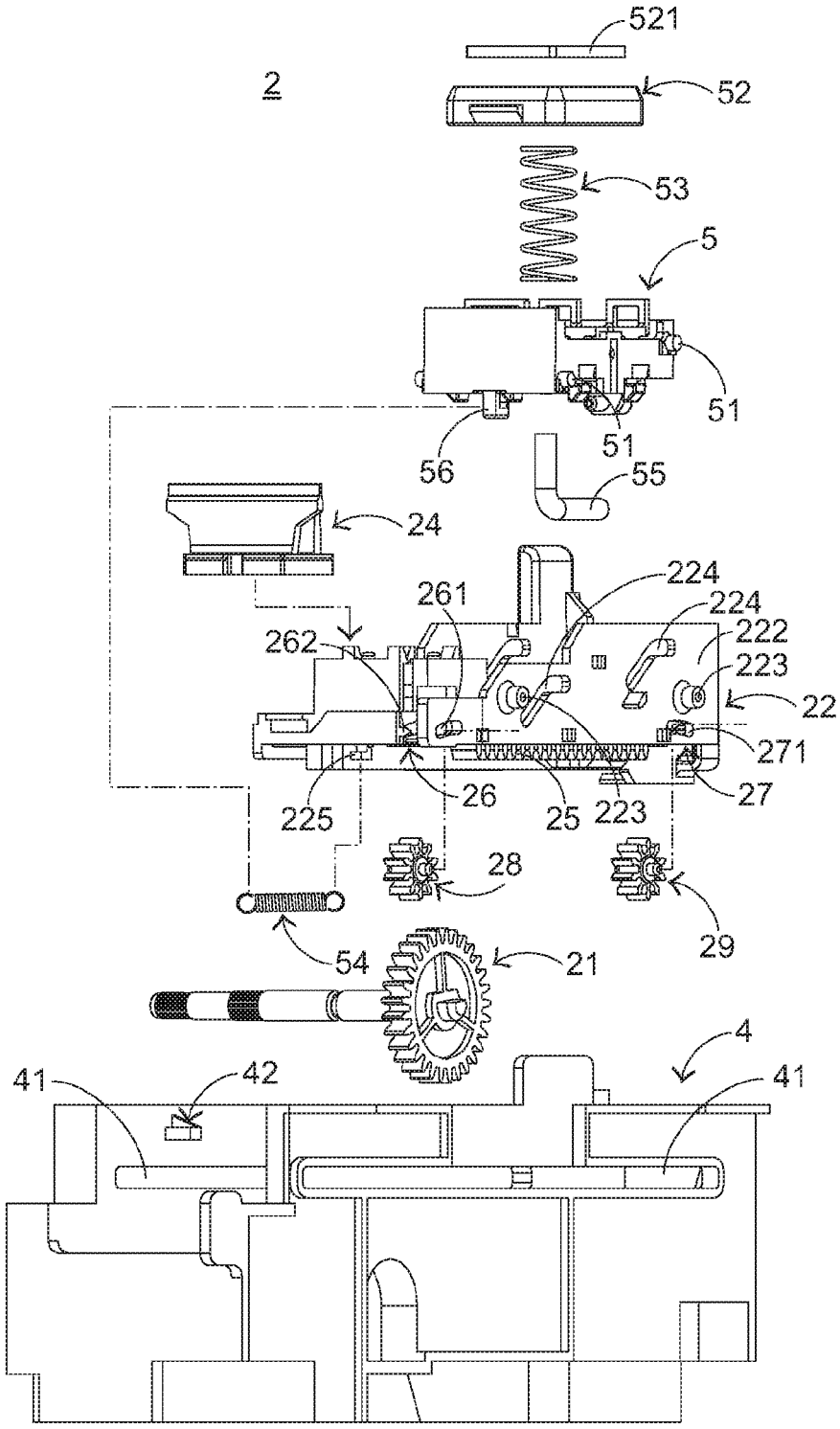
FIG. 3 is a schematic exploded view illustrating the inkjet head maintenance device of FIG. 2.

Please refer to FIG. 3, which is a schematic exploded view illustrating the inkjet head maintenance device of FIG. 2. As shown in FIG. 3, the inkjet head maintenance device 2 comprises a power gear 21, a sliding seat 22, a base member 4 and a supporting seat 5. The power gear 21 is used for providing a driving force to the sliding seat 22. In response to the driving force, the sliding seat 22 is movable under the inkjet head 3 (not shown in FIG. 3) in a reciprocating manner to clean the inkjet head 3. The sliding seat 22 has a scraping element 24. During the sliding seat 22 is moved under the inkjet head 3 in the reciprocating manner, the scraping element 24 may scrape the residual ink on the inkjet head 3 in order to clean the inkjet head 3. The sliding seat 22 comprises a rack 25, a first receptacle 26, a second receptacle 27, a first one-way gear 28 and a second one-way gear 29. The rack 25 is engaged with the power gear 21. In a case that the power gear 21 is rotated in an anti-clockwise direction, the sliding seat 22 is moved to a maintenance position. Whereas, in a case that the power gear 21 is rotated in a clockwise direction, the sliding seat 22 is moved to a standby position.

Figure 4:
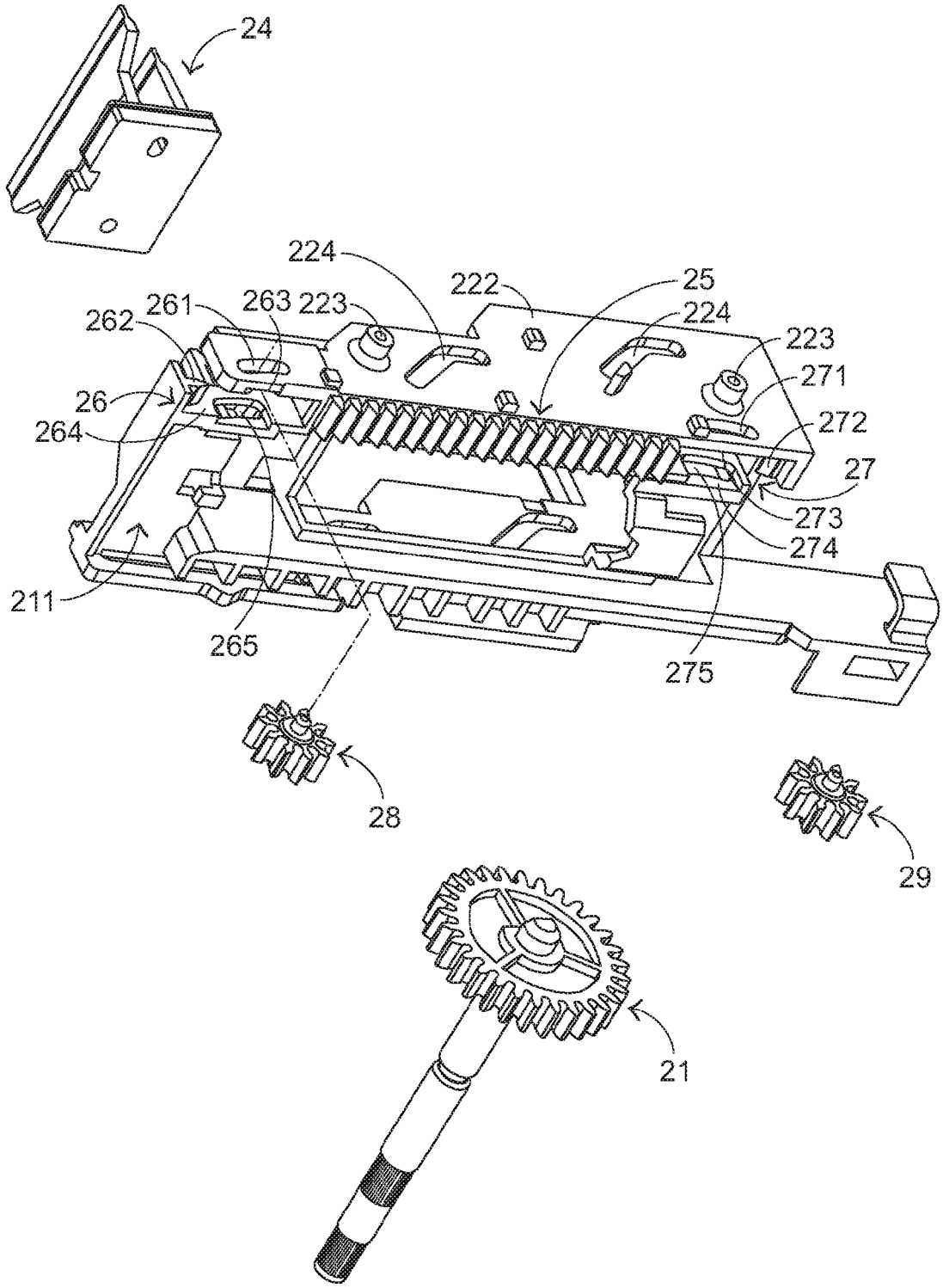
FIG. 4 is a schematic exploded view illustrating some components of the inkjet head maintenance device of FIG. 2.

Please refer to FIGS. 3 and 4. The rack 25, the first receptacle 26 and the second receptacle 27 are arranged at a bottom surface 221 of the sliding seat 22. In addition, the first receptacle 26 and the second receptacle 27 are respectively arranged at two ends of the rack 25. The first receptacle 26 comprises a first guiding slot 261 and a first fastening structure 262. The first guiding slot 261 is formed in a first sidewall 263 of the first receptacle 26. The second receptacle 27 comprises a second guiding slot 271 and a second fastening structure 272. The second guiding slot 271 is formed in a second sidewall 273 of the second receptacle 27. The first one-way gear 28 and the second one-way gear 29 are disposed within the first guiding slot 261 and the second guiding slot 271, respectively. The first one-way gear 28, the second one-way gear 29 and the toothed part of the rack 25 are arranged along the same line. Optionally, a third guiding slot 265 is formed in a third sidewall 264, which is opposed to the first sidewall 263; and a fourth guiding slot 275 is formed in a fourth sidewall 274, which is opposed to the second sidewall 273. In such way, the first one-way gear 28 is linearly movable along the first guiding slot 261 and the third guiding slot 265, and the second one-way gear 29 is linearly movable along the second guiding slot 271 and the fourth guiding slot 275.

Moreover, the base member 4 comprises a sliding track 41 and a stopping part 42. A first protruding post 223 is disposed on a sidewall 222 of the sliding seat 22. The first protruding post 223 is accommodated within the sliding track 41 of the base member 4, so that the sliding seat 22 is movable along the sliding track 41. The sliding seat 22 further comprises an ascending and descending track 224. The supporting seat 5 comprises a second protruding post 51 and a supporting tray 52. The second protruding post 51 of the supporting seat 5 is accommodated within the ascending and descending track 224 of the sliding seat 22. The supporting seat 5 is connected with the sliding seat 22 through a second elastic element 54. A first end of the second elastic element 54 is connected with a first hooking part 56 of the supporting seat 5. A second end of the second elastic element 54 is connected with a second hooking part 225 of the sliding seat 22. The supporting tray 52 is connected with the supporting seat 5 through a first elastic element 53. In addition, the supporting tray 52 is used for enclosing the inkjet head 3. In addition, an ink-absorbing sponge 521 is disposed on the supporting tray 52 for absorbing the residual ink on the inkjet head 3. If too much residual ink is accumulated, the excessive ink is exhausted out through an ink-discharging tube 55, which is disposed on the supporting seat 5 and in communication with the supporting tray 52.

Figure 5A:
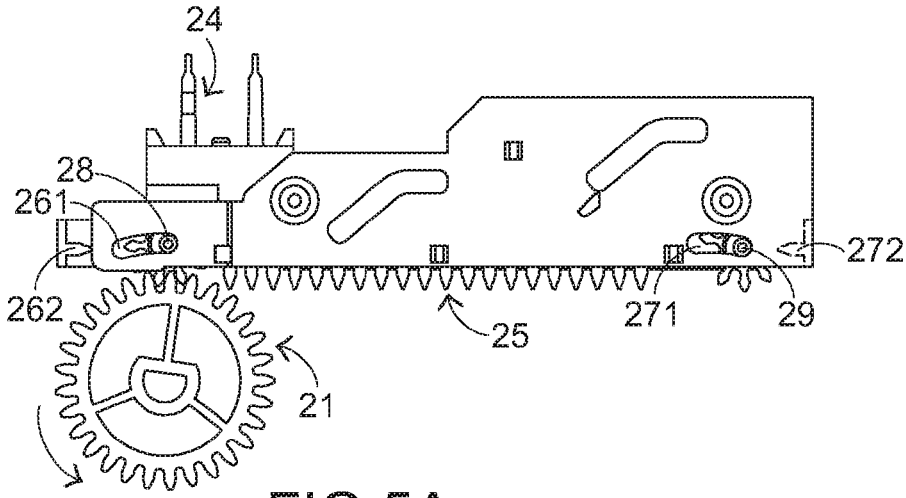
FIGS. 5A, 5B and 5C are schematic side views illustrating the operations of the inkjet head maintenance device of the present invention, in which the sliding seat is moved from the standby position to the maintenance position.
Figure 5B:
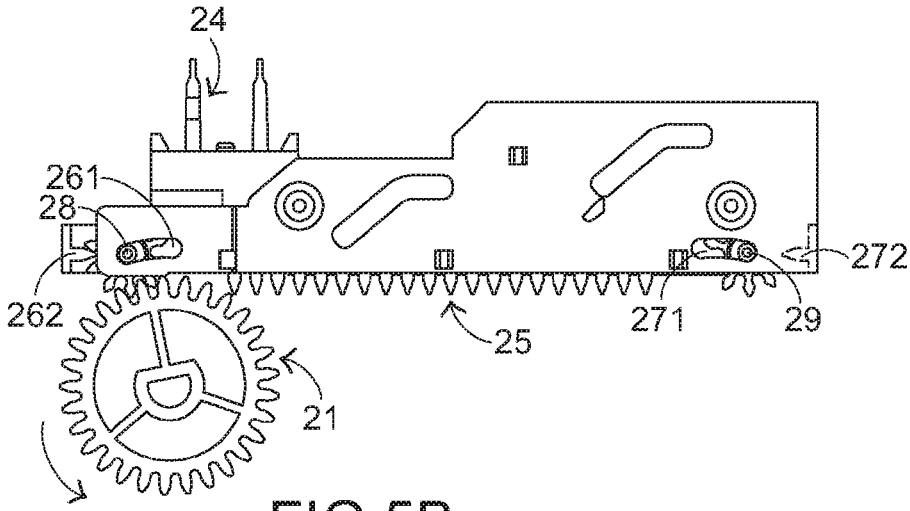
Figure 5C:
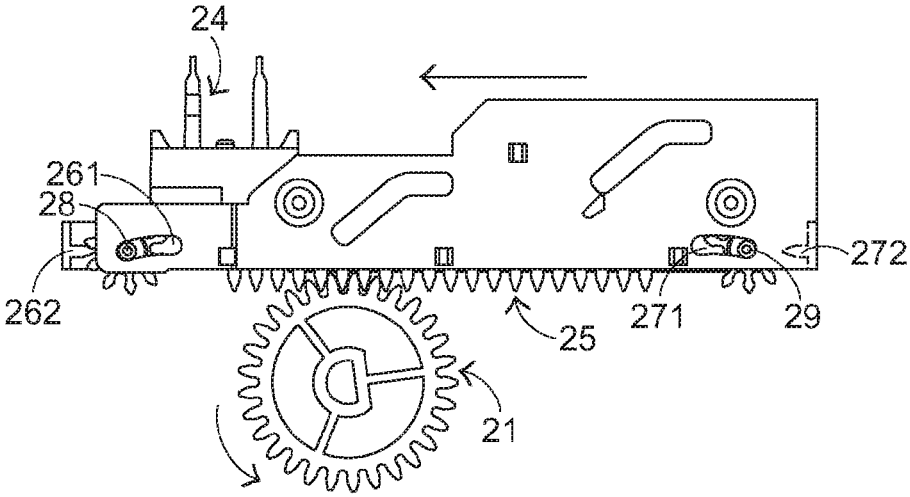

Hereinafter, the task of cleaning and maintaining the inkjet head 3 by the inkjet head maintenance device 2 will be illustrated with reference to FIGS. 5A, 5B and 5C. FIGS. 5A, 5B and 5C are schematic side views illustrating the operations of the inkjet head maintenance device of the present invention, in which the sliding seat is moved from the standby position to the maintenance position. Firstly, the sliding seat 22 is stayed in the standby position. Once the inkjet head 3 is moved to a position over the inkjet head maintenance device 2, the power gear 21 is rotated in a first direction (e.g. an anti-clockwise direction) (see FIG. 5A). In response to the rotation of the power gear 21 in the first direction, the first one-way gear 28 is linearly moved along the first guiding slot 261 in the direction away from the rack 25 (see FIG. 5B). Until the first one-way gear 28 is coupled with the first fastening structure 262, the first one-way gear 28 stops rotation. Then, the power gear 21 is disengaged from the first one-way gear 28 and then engaged with the rack 25 (see FIG. 5C). In response to continuous rotation of the power gear in the first direction, the sliding seat 22 is departed from the standby position and moved toward the maintenance position. During the sliding seat 22 is moved from the standby position to the maintenance position, the scraping element 24 is contacted with the inkjet head 3 to scrape off the residual ink on the periphery of the inkjet head 3, thereby achieving the cleaning purpose. It is noted that, in the inkjet head maintenance device of the present invention, the rotating speed, the rotating direction and the reverse rotating frequency of the power gear 21 may be adjusted by a controller (not shown) according to predetermined parameters. As a consequence, the scraping element 24 on the sliding seat 22 will be moved forwardly and backwardly to perform the cleaning task of scraping off the residual ink of the inkjet head 3.

Figure 6A:
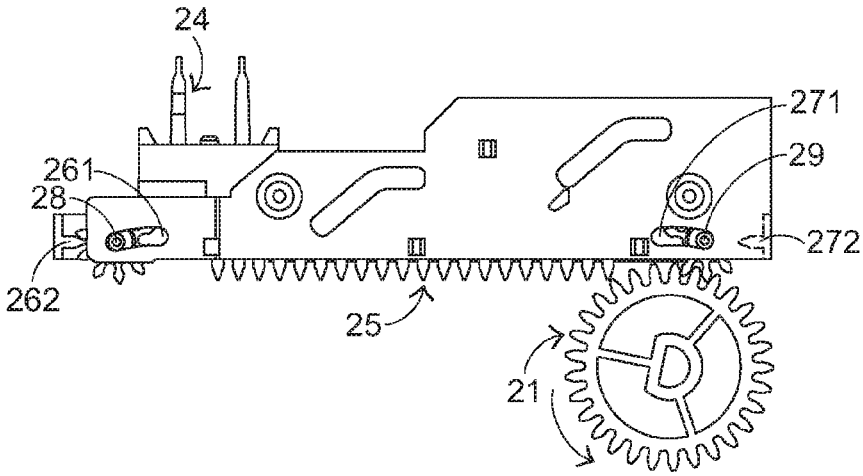
FIGS. 6A, 6B and 6C are schematic side views illustrating the operations of the inkjet head maintenance device of the present invention, in which the sliding seat is moved from the maintenance position to the standby position.
Figure 6B:
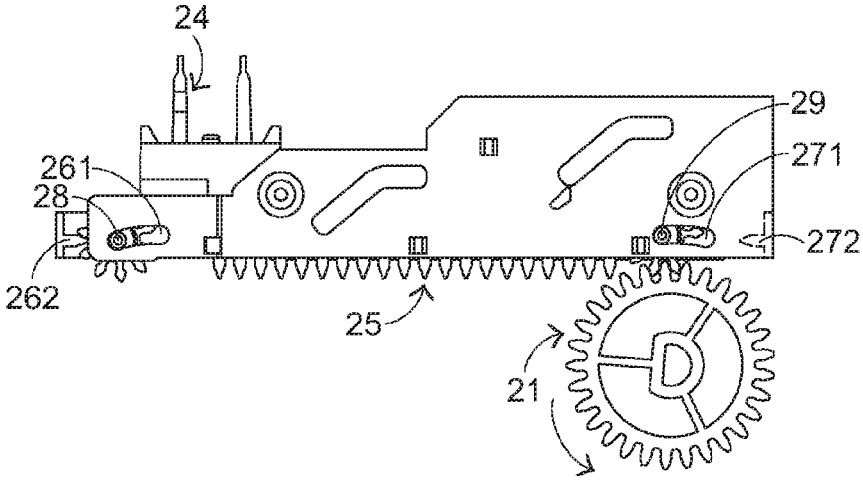
Figure 6C:
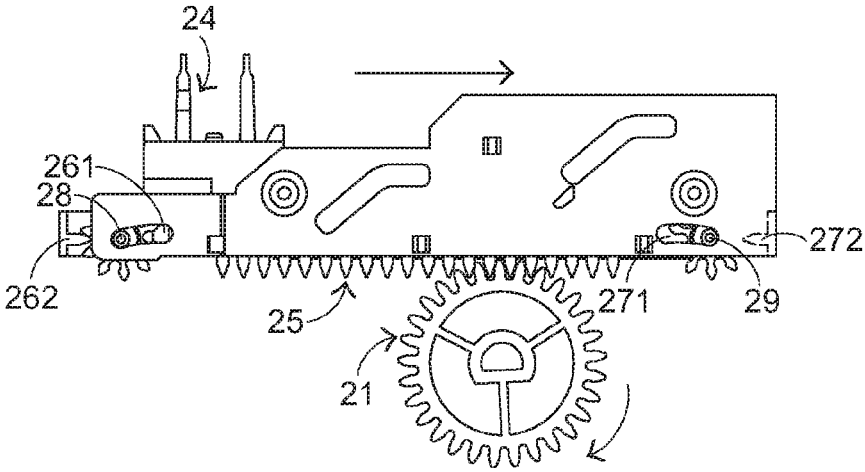

FIGS. 6A, 6B and 6C are schematic side views illustrating the operations of the inkjet head maintenance device of the present invention, in which the sliding seat is moved from the maintenance position to the standby position. When the sliding seat 22 is moved to the maintenance position, the power gear 21 is disengaged from the rack 25 and then engaged with the second one-way gear 29 (see FIG. 6A). Consequently, the second one-way gear 29 is linearly moved along the second guiding slot 272 to be detached from the second fastening structure 272, and moved toward the rack 25 (see FIG. 6B). Meanwhile, since the rotations of the power gear 21 and the second one-way gear 29 are simultaneously idle, the sliding seat 22 is stayed in the maintenance position. After the inkjet head 3 is enabled to perform a printing task, the power gear 21 is rotated in a second direction. In response to the rotation of the power gear 21 in the second direction, the second one-way gear 29 is linearly moved along the second guiding slot 271 in the direction away from the rack 25. Until the second one-way gear 29 is coupled with the second fastening structure 272, the second one-way gear 29 stops rotation. Then, the power gear 21 is disengaged from the second one-way gear 29 and then engaged with the rack 25 (see FIG. 6C). In response to continuous rotation of the power gear 21 in the second direction, the sliding seat 22 is moved to the standby position to wait orders.

Figure 7:
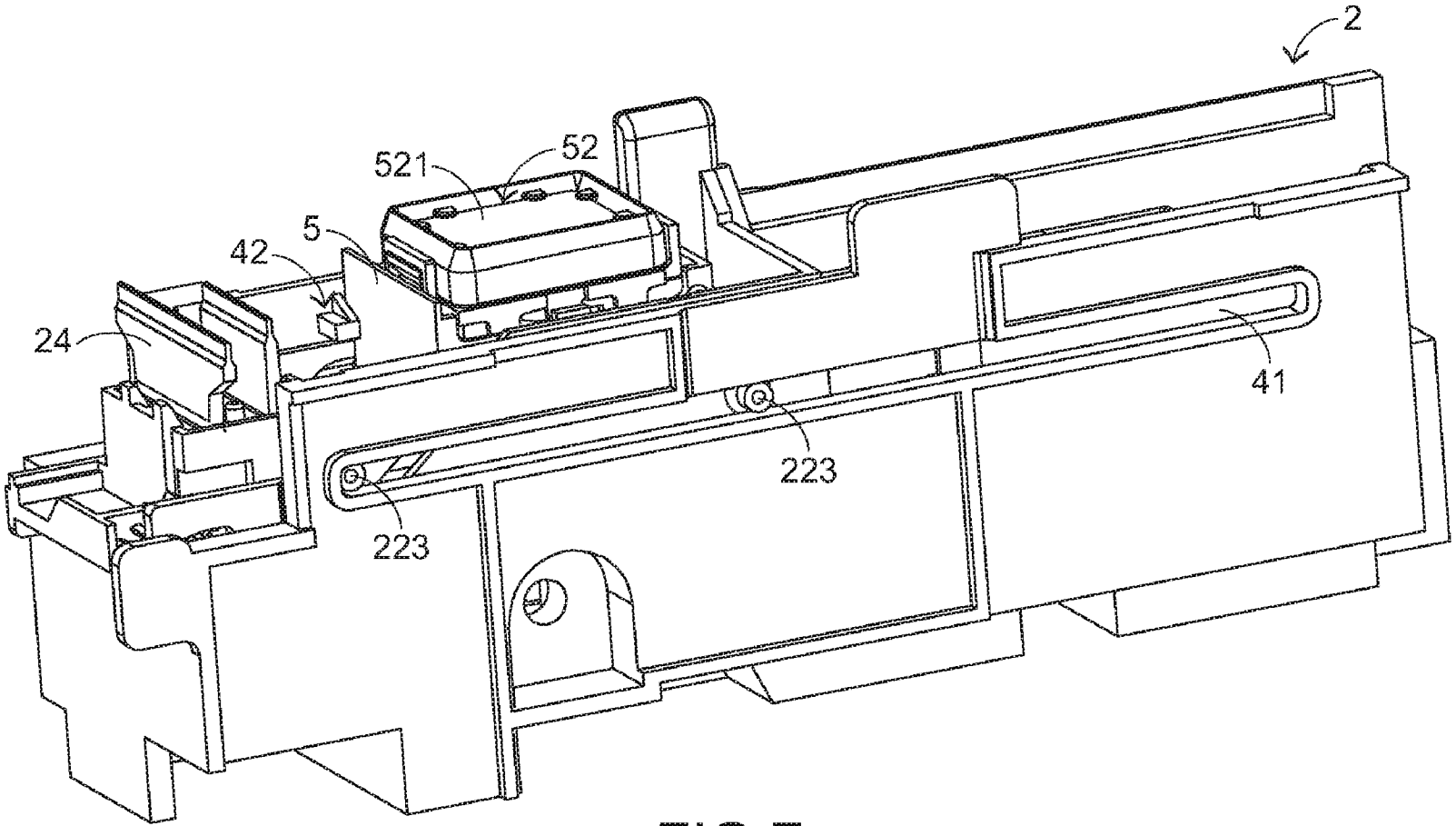
FIG. 7 is a schematic perspective view illustrating the inkjet head maintenance device of FIG. 2 in the maintenance position.

FIG. 7 is a schematic perspective view illustrating the inkjet head maintenance device of FIG. 2 in the maintenance position. Please refer to FIGS. 2, 3 and 7. During the sliding seat 22 is moved toward the maintenance position, the supporting seat 5 is stopped by the stopping part 42. During the sliding seat 22 is continuously moved toward the maintenance position, the second elastic element 54 is stretched, and the stopped supporting seat 5 is ascended with respect to the sliding seat 22 along the trajectory of the ascending and descending track 224. Until the sliding seat 22 is moved to the maintenance position, the inkjet head 3 is enclosed by the supporting tray 52. Since the supporting tray 52 is connected with the supporting seat 5 through the first elastic element 52, when the inkjet head 3 is enclosed by the supporting tray 52, the first elastic element 53 is compressed. The compressed first elastic element 53 provides an upright force to allow the supporting tray 52 to tightly enclose the inkjet head 3. In such way, the ink-absorbing sponge 521 on the supporting tray 52 can effectively absorb the residual ink on the inkjet head 3, thereby achieving the purpose of cleaning the inkjet head 3 and keeping the humidity of the inkjet head 3. Whereas, during the sliding seat 22 is moved toward the standby position, the supporting seat 5 is detached from the stopping part 42 and the supporting tray 52 is detached from the inkjet head 3. Meanwhile, in response to a tension force provided by the stretched second elastic element 54, the supporting seat 5 is descended with respect to the sliding seat 22 along the trajectory of the ascending and descending track 224. Consequently, the supporting seat 5 is returned to the original position.

Figure 1:
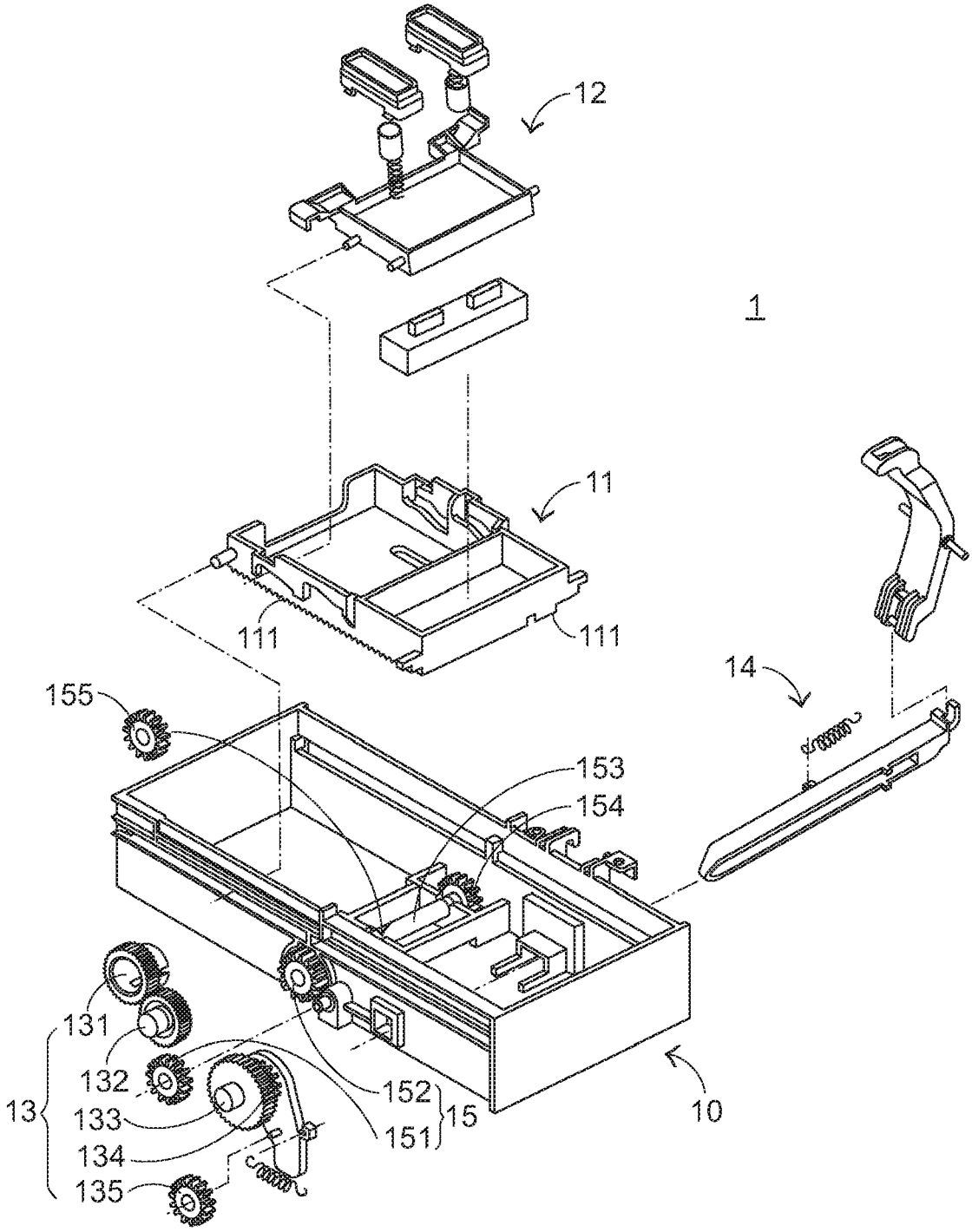
FIG.1 PRIOR ART
FIG. 1 is a schematic exploded view illustrating a conventional inkjet head maintenance device.

From the above description, the number of gears used in the inkjet head maintenance device of the present invention is largely reduced when compared with the conventional inkjet head maintenance device of FIG. 1. In other word, the inkjet head maintenance device of the present invention has simplified configurations and low assembling complexity.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An inkjet head maintenance device for cleaning and maintaining an inkjet head, said inkjet head maintenance device comprising:

a power gear for providing a driving force;

a sliding seat, wherein a scraping element is disposed on said sliding seat for scraping off residual ink on said inkjet head, wherein said sliding seat further comprises:

a rack to be engaged with said power gear, so that said sliding seat is moved between a standby position and a maintenance device in response to rotation of said power gear;

a first guiding slot and a second guiding slot arranged at two ends of said rack, respectively;

a first fastening part and a second fastening part arranged at said two ends of said rack, respectively; and a first one-way gear and a second one-way gear disposed within said first guiding slot and said second guiding slot, respectively, wherein when said sliding seat is in said standby position, in response to rotation of said power gear in a first direction, said first one-way gear is coupled with said first fastening, so that said power gear is disengaged from said first one-way gear and then engaged with said rack, wherein when said power gear is engaged with said rack, in response to continuous rotation of said power gear in said first direction, said sliding seat is departed from said standby position and moved toward said maintenance position, wherein when said sliding seat is moved to said maintenance position, said power gear is disengaged from said rack and then engaged with said second one-way gear, so that said second one-way gear is detached from said second fastening part to result in idle running and said sliding seat is stayed in said maintenance position, wherein when said sliding seat is stayed in said maintenance position, in response to rotation of said power gear in a second direction, said power gear allows said second one-way gear to be coupled with said second fastening part, and said power gear is disengaged from said second one-way gear and then engaged with said rack, so that said sliding seat is moved toward said standby position.

2. The inkjet head maintenance device according to claim 1 wherein said sliding seat further comprises a first receptacle and a second receptacle, which are arranged at said two ends of said rack, respectively, wherein said first guiding slot and said first fastening structure are disposed in said first receptacle, and said second guiding slot and said second fastening structure are disposed in said second receptacle.

3. The inkjet head maintenance device according to claim 2 wherein said rack, said first receptacle and said second receptacle are arranged at a bottom surface of said sliding seat.

4. The inkjet head maintenance device according to claim 1 wherein said first one-way gear and said second one-way gear are linearly movable within said first guiding slot and said second guiding slot, respectively.

5. The inkjet head maintenance device according to claim 1 wherein said inkjet head maintenance device further comprises a base member with a sliding track, and said sliding seat further comprises a first protruding post accommodated within said sliding track, so that said sliding seat is movable along said sliding track.

6. The inkjet head maintenance device according to claim 5 wherein said inkjet head maintenance device further comprises a supporting seat with a supporting tray and a second protruding post, and said sliding seat further comprises an ascending and descending track, wherein said second protruding post is accommodated within said ascending and descending track, and said inkjet head is enclosed by said supporting tray.

7. The inkjet head maintenance device according to claim 6 wherein said base member further comprises a stopping part, wherein when said sliding seat is moved toward said maintenance position in response to rotation of said power gear in said first direction, said supporting seat is stopped by said stopping part, and second protruding post is ascended along said ascending and descending track, so that said supporting seat is ascended with respect to said sliding seat to enclose said inkjet head.

8. The inkjet head maintenance device according to claim 7 wherein said supporting tray is connected with said supporting seat through a first elastic element, wherein when said supporting seat is ascended with respect to said sliding seat to enclose said inkjet head, in response to an elastic force provided by said first elastic element, said inkjet head is tightly enclosed by said supporting tray.

9. The inkjet head maintenance device according to claim 6 wherein said supporting post is connected with said sliding seat through a second elastic element, wherein when said sliding seat is moved toward said standby position in response to rotation of said power gear in said second direction, said supporting seat is detached from said stopping part, and in response to a tension force provided by said second elastic element, said second protruding post is descended along said ascending and descending track, so that said supporting seat is descended with respect to said sliding seat.

10. The inkjet head maintenance device according to claim 6 wherein an ink-absorbing sponge is disposed on said supporting tray for absorbing said residual ink on said inkjet head.

11. The inkjet head maintenance device according to claim 10 wherein said supporting seat further comprises an ink-discharging tube, wherein said residual ink absorbed by said ink-absorbing sponge is exhausted out through said ink-discharging tube.

* * * * *